US009574310B2

(12) United States Patent
Johnson et al.

(10) Patent No.: US 9,574,310 B2
(45) Date of Patent: Feb. 21, 2017

(54) METHOD AND APPARATUS FOR CUTTING A SINUSOIDAL GROOVE IN A ROAD SURFACE

(71) Applicant: SURFACE PREPARATION TECHNOLOGIES, LLC, Mechanicsburg, PA (US)

(72) Inventors: H. Matthew Johnson, Shermansdale, PA (US); Jeffrey M. Dows, Mechanicsburg, PA (US)

(73) Assignee: SURFACE PREPARATION TECHNOLOGIES LLC, Mechanicsburg, PA (US)

( * ) Notice: Subject to any disclaimer, the term of this patent is extended or adjusted under 35 U.S.C. 154(b) by 0 days.

(21) Appl. No.: 14/489,737

(22) Filed: Sep. 18, 2014

(65) Prior Publication Data

US 2015/0086268 A1 Mar. 26, 2015

Related U.S. Application Data

(60) Provisional application No. 61/880,385, filed on Sep. 20, 2013.

(51) Int. Cl.
*E01C 19/00* (2006.01)
*E01C 21/00* (2006.01)
*E01C 23/09* (2006.01)

(52) U.S. Cl.
CPC ..... *E01C 19/004* (2013.01); *E01C 21/00* (2013.01); *E01C 23/0993* (2013.01)

(58) Field of Classification Search
CPC ..... B05D 5/06; E01C 23/16; E01C 19/004; E01C 21/00; E01C 23/0993
USPC ..... 404/9–94, 96
See application file for complete search history.

(56) References Cited

U.S. PATENT DOCUMENTS

| | | | |
|---|---|---|---|
| 2,574,090 | A | 11/1951 | Dofsen |
| 2,826,128 | A | 3/1958 | Summers |
| 3,094,046 | A | 6/1963 | Zipelius |
| 3,266,846 | A | 8/1966 | Luksch et al. |
| 3,407,006 | A | 10/1968 | Simms et al. |
| 3,529,517 | A | 9/1970 | Murray |
| 3,801,211 | A | 4/1974 | Perkins |
| 3,868,146 | A | 2/1975 | Ellis |
| 3,874,806 | A | 4/1975 | Grist et al. |
| 3,929,377 | A | 12/1975 | Weaver et al. |
| 3,975,055 | A | 8/1976 | Wirtgen |
| 4,270,410 | A | 6/1981 | Herscovici |
| 4,281,560 | A | 8/1981 | Herscovici |

(Continued)

FOREIGN PATENT DOCUMENTS

| | | | |
|---|---|---|---|
| DE | 2209743 | A1 | 9/1973 |
| DE | 3200862 | A1 | 7/1983 |

(Continued)

*Primary Examiner* — Raymond W Addie
(74) *Attorney, Agent, or Firm* — Spilman Thomas & Battle, PLLC

(57) ABSTRACT

A system for controlling a cutting machine for cutting continuous sinusoidal strips in a road surface includes a rotatable cutting head, a cylinder for driving the cutting head out of and into contact with the road surface, and a controller. The controller is programmed to execute an input/output function to control the cylinder to cut a subsurface sinusoidal strip wherein the cutting drum remains in the road surface once the cutting operation begins.

18 Claims, 8 Drawing Sheets

(56) References Cited

U.S. PATENT DOCUMENTS

| | | | | |
|---|---|---|---|---|
| 4,463,989 | A | 8/1984 | Kennedy | |
| 4,575,278 | A | 3/1986 | Whitney | |
| 4,640,553 | A | 2/1987 | Zelenka | |
| 4,701,069 | A | 10/1987 | Whitney | |
| 4,723,867 | A | 2/1988 | Wirtgen | |
| 4,725,097 | A | 2/1988 | Zelenka | |
| 4,778,304 | A | 10/1988 | Baldi et al. | |
| 4,797,025 | A | 1/1989 | Kennedy | |
| 4,834,462 | A | 5/1989 | Yamashita | |
| 4,852,946 | A | 8/1989 | Hackmach | |
| 4,854,769 | A | 8/1989 | Fukukawa et al. | |
| 4,854,770 | A | 8/1989 | Puchala et al. | |
| 4,878,713 | A | 11/1989 | Zanetis | |
| 4,892,328 | A | 1/1990 | Kurtzman et al. | |
| 4,896,995 | A | 1/1990 | Simmons | |
| 4,900,094 | A | 2/1990 | Sergeant | |
| 4,909,575 | A | 3/1990 | Lupton | |
| 5,046,890 | A | 9/1991 | Dickson | |
| 5,094,565 | A | 3/1992 | Johnson | |
| 5,104,195 | A | 4/1992 | Zaccho | |
| 5,129,755 | A | 7/1992 | Dickson | |
| 5,203,923 | A | 4/1993 | Hartman | |
| 5,215,071 | A | 6/1993 | Mertes et al. | |
| 5,236,278 | A | 8/1993 | Dickson | |
| 5,297,894 | A | 3/1994 | Yenick | |
| 5,378,080 | A | 1/1995 | Dickson | |
| 5,415,495 | A | 5/1995 | Johnson | |
| 5,857,453 | A | 1/1999 | Caven et al. | |
| 6,402,252 | B1 * | 6/2002 | Dickson | E01C 23/0993 299/39.6 |
| 6,755,482 | B2 | 6/2004 | Johnson | |
| 7,168,886 | B2 | 1/2007 | Loader | |
| 7,837,276 | B2 | 11/2010 | Kraemer et al. | |
| 8,025,342 | B2 | 9/2011 | Kraemer et al. | |
| 8,821,063 | B2 | 9/2014 | Johnson et al. | |
| 2002/0192025 | A1 | 12/2002 | Johnson | |
| 2004/0005190 | A1 | 1/2004 | Jakits | |
| 2004/0208696 | A1 * | 10/2004 | Watts | E01F 9/047 404/17 |
| 2005/0265783 | A1 * | 12/2005 | Amir | E01F 9/047 404/15 |
| 2006/0268284 | A1 | 11/2006 | Zhang et al. | |
| 2008/0152428 | A1 | 6/2008 | Berning et al. | |
| 2009/0311045 | A1 | 12/2009 | Jurasz et al. | |
| 2013/0140870 | A1 | 6/2013 | Johnson et al. | |

FOREIGN PATENT DOCUMENTS

| | | | |
|---|---|---|---|
| WO | 2007144678 | A1 | 12/2007 |
| WO | 2013177516 | A1 | 11/2013 |

* cited by examiner

METHOD AND APPARATUS FOR CUTTING A SINUSOIDAL GROOVE IN A ROAD SURFACE

CROSS-REFERENCE TO RELATED APPLICATIONS

This patent application claims priority to and the benefit of U.S. Provisional Patent Application No. 61/880,385, filed Sep. 20, 2013, entitled "CONTROL SYSTEM AND METHOD FOR ROAD CUTTING MACHINE", which is hereby incorporated by reference.

BACKGROUND

The application generally relates to a method and apparatus for cutting a groove in a road surface. The application relates more specifically to a method and apparatus for cutting grooves having a sinusoidal profile in a road surface for alerting a driver when a vehicle is outside of the traffic lane.

As motor vehicle operators become fatigued or distracted, the possibility of the vehicle drifting off the road or over the center line and into the opposite lane of traffic increases, either of which can potentially lead to disastrous results. To minimize this occurrence, a series of depressions are cut along the shoulders or center line of the roadway, referred to as ground-in rumble strips. The purpose of the rumble strip is to alert drivers when they have drifted outside their traffic lane by creating a sound and causing vibration to their motor vehicle as its tires travel over the depressions.

One problem associated with rumble strips is that the noise generated by tires travelling over the depressions can be a significant disturbance to homes and businesses located near the roadway. The noise that is desirable for alerting inattentive drivers may be a nuisance to persons living adjacent to the roadway. One solution to reduce the noise levels significantly is to provide a sinusoidal rail or strip along the traffic lanes. These rails are designed to have a sinusoidal profile that generates interior noise and vibration within the vehicle to alert the driver, while generating substantially less external noise to lessen the disturbances to adjacent residents and property owners.

One example of such a rail system is disclosed in U.S. Pat. No. 7,168,886 to Loader. Loader discloses depositing molten material on the surface of the roadway or path and molding the molten material so that its upper surface has a generally sinusoidal profile. Loader uses a pair of substantially longitudinal rails positioned on the surface of the road so as to be spaced apart from each other such that they are substantially aligned with the intended direction of travel. The upper surface of the rails exhibits the required profile which extends along the length of said rails and the rails are positioned on the road so as to be mutually parallel. A disadvantage of such surface mounted rails is that they are not compatible with existing snow plows and road maintenance equipment that scrapes or otherwise removes objects from the road surface. Since the rails project above the road surface and are not integral with the road surface, they may be worn and broken due to heavy truck wheels and lack of lateral support. In addition, construction of sinusoidal rails on top of a road surface adds to the cost of road construction materials and delays completion due to the time to install the rails.

Further, when applying a sinusoidal rail system to a road surface, care must be taken in butting two strips together so that the profile peaks and troughs match up. Also, the edges must be tamped down so as to avoid producing a tripping hazard. Thermoplastic applications can become slippery when wet and create safety issues.

Intended advantages of the disclosed systems and/or methods satisfy one or more of these needs or provide other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment includes a system for controlling a cutting machine for cutting a continuous sinusoidal strip in a road surface. The system includes a rotatable cutting head, a cylinder connected to the rotatable cutting head for driving the rotatable cutting head into contact with the road surface, and a controller. The controller controls the cylinder to adjust the cutting head in continuous engagement with the road surface and to cut a strip having a variable depth in the road surface wherein the variable depth provides a sinusoidal cross-sectional profile in the road surface.

Another embodiment includes a method for cutting continuous sinusoidal strips in a road surface including specifying a proportional gain and a depth increment for each speed input value for progressively increasing speed input values; executing an input/output function for a controller; providing an Input/Output (I/O) function based on a plurality of predetermined cutting machine speed input values; determining an instantaneous proportional gain and depth increment output value according to a linear interpolation applied between the next lower and the next greater speed values; varying a proportional gain and an error amplification signal over a range of forward speed of the cutting machine; outputting an instantaneous proportional gain and depth increment from the controller to a control device for cutting a continuous sinusoidal strip in the road surface; and cutting the continuous strip having a sinusoidal cross-sectional profile in the road surface.

Certain advantages of the embodiments described herein are the ability to automatically and continuously cut a continuous sinusoidal strip into a road surface to provide an improved continuous sinusoidal strip feature in a roadway for notifying a driver that his or her vehicle is outside of the normal traffic lane.

Another advantage is the ability to produce a sinusoidal rumble strip with low external sound levels to protect the environment, and with sufficient internal sound levels to alert a driver that the vehicle is outside of its normal traffic lane.

Still another advantage of the sinusoidal rumble strip is the ability to easily apply broken paint lines along a side or the center of a roadway, by applying the paint along a portion of the rumble strip at the peaks of the sinusoidal profile and passing over the lower portion of the rumble strip with the paint applicator.

DETAILED DESCRIPTION OF THE EXEMPLARY EMBODIMENTS

Figure 1:
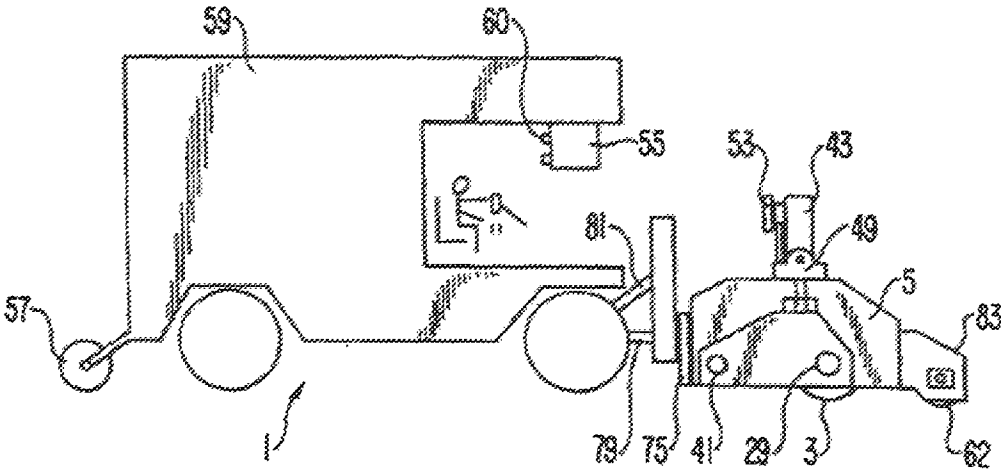
FIG. 1 PRIOR ART
FIG. 1 is an elevational view of a cutting machine.
Figure 2:
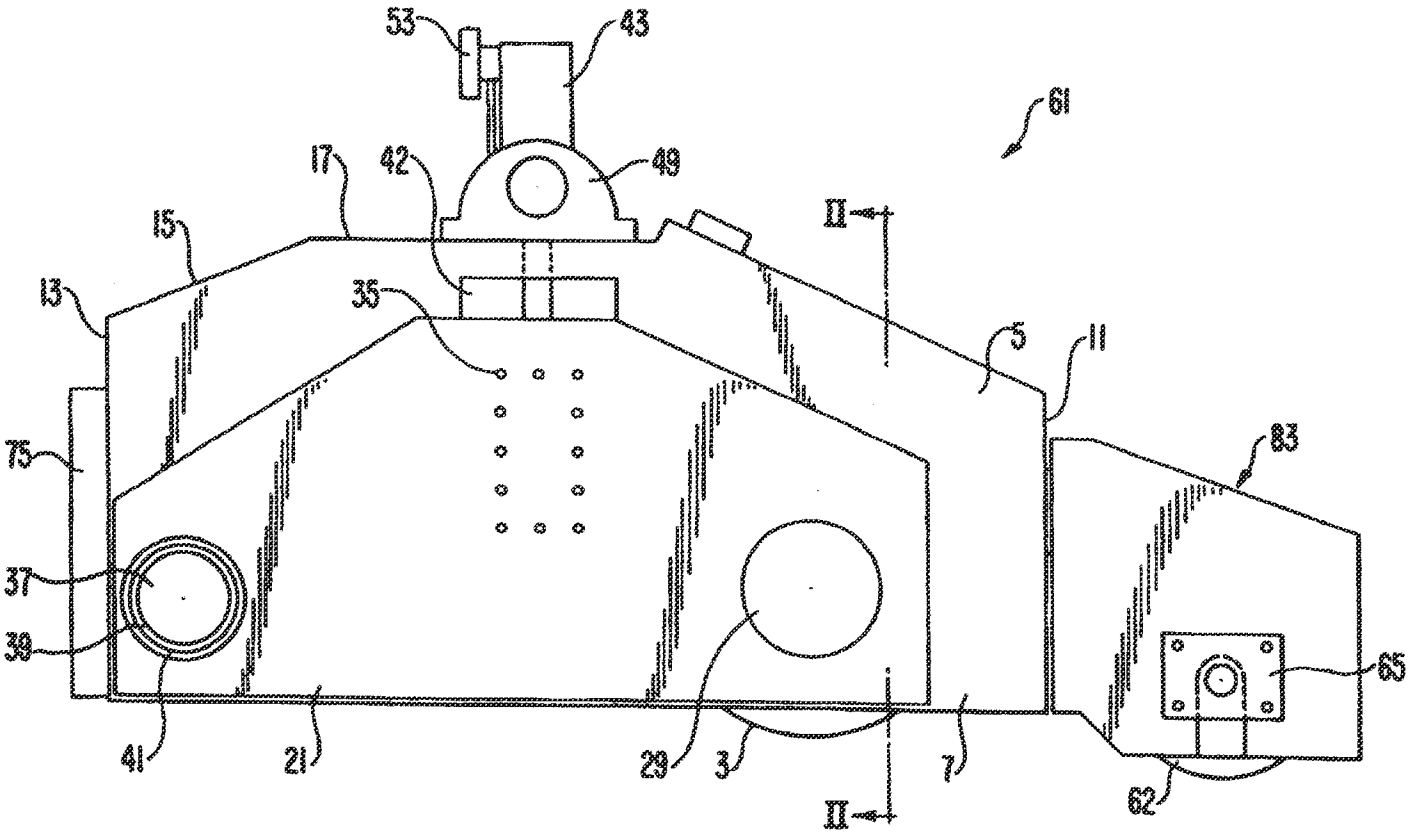
FIG. 2 is an elevational view of the cutting apparatus.
Figure 3:
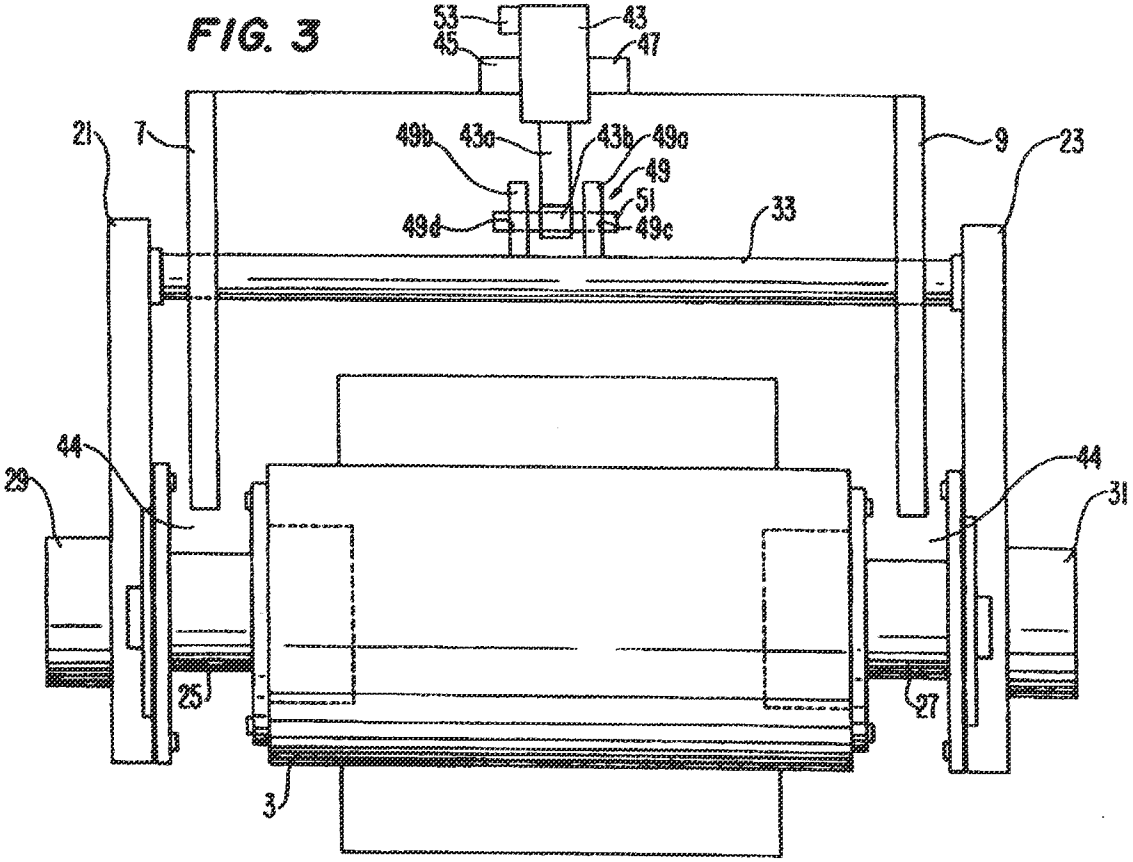
FIG. 3 is a sectional view of the cutting apparatus showing a front view of the cutting head, taken along the lines II-II in FIG. 2.
Figure 4:
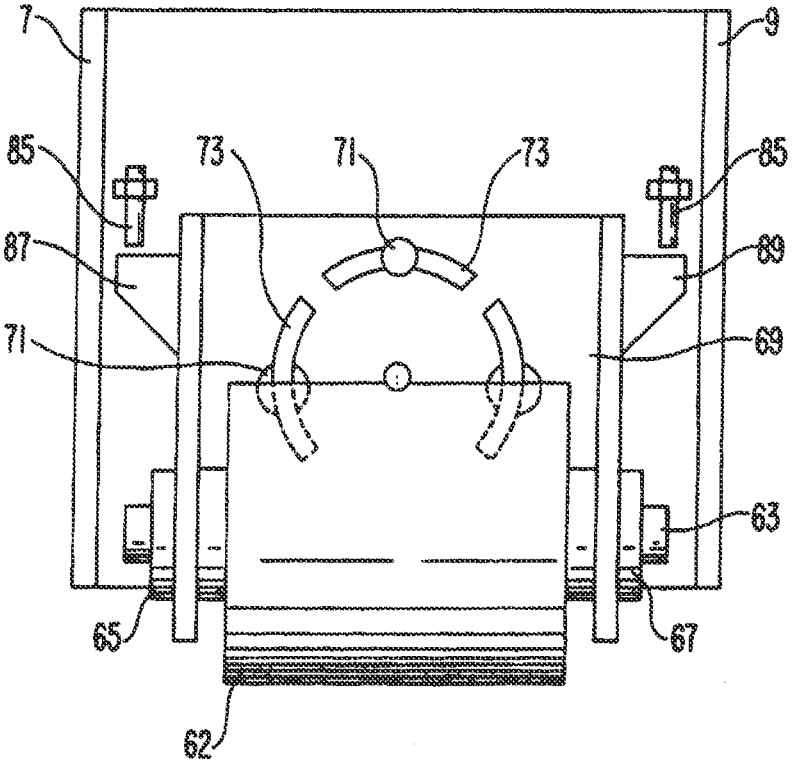
FIG. 4 is a front view of the front roller assembly.

Referring now to the drawings, and particularly to FIGS. 1-3, a cutting machine 1 includes a conventional cutting head/drum 3 contained within a housing weldment 5 having a pair of opposed, substantially parallel, vertically extending side walls 7 and 9. In addition, the housing weldment 5 contains front and rear parallel sidewalls 11 and 13, and two top plates 15, 17 forming part of the top of the housing 5. The bottom of the housing 5 is substantially open.

Referring to FIGS. 2 and 3, the cutting drum 3 is carried within the housing 5 by two arm plates 21 and 23. The cutting drum 3 is attached to each of the arm plates 21 and 23 through respective gear boxes 25 and 27 which contain bearings therein. The gear boxes 25 and 27 are each rigidly attached at one end thereof to the respective arm plate, which allows the opposite end of the gear boxes 25 and 27 to rotate the cutting drum 3. The cutting drum 3 is driven in a conventional manner, e.g., by one or two hydraulic motors 29 and 31 which are respectively mounted through the arm plates 21 and 23 and into a respective gear box 25 and 27. The cutting drum 3 is rotated in a counter clockwise/up cut direction relative to a road surface, and uses diamond tipped or tungsten carbide tipped teeth or blade to cut with. Furthermore, while a hydraulic motor driven system for the cutting heads has been described, other conventional direct or indirect drive systems can be used in lieu thereof, such as a belt driven system.

The arm plates 21, 23 are interconnected at one end by the cutting drum 3 and drive mechanism described above. The arm plates 21, 23 are also interconnected by an I-beam 33 which is connected to each arm plate 21, 23 via bolts 35. The arm plates 21, 23 are also connected at the rear of the housing 5 by a solid shaft 37 which pivots against bearings 39, each of which are contained in a tube 41. The tube 41 is welded to and made part of the housing 5. The combination of the shaft 37, bearings 39 and tube 41 allows the cutting drum 3 and arm plates 21, 23 to pivot up and down. The up and down movement of the cutting drum 3 allows it to be engaged and disengaged with the road surface. Moreover, slots or opening 42 are provided in the side walls 7 and 9 to accommodate the movement of the I-beam 33. Additional slots or openings 44 which extend from the bottom edges of side walls 7, 9 allow for movement of the cutting drum 3 and drive mechanism without interference from the side walls 7, 9.

The cutting mechanism (cutting drum 3, arm plates 21, 23 and gear boxes 25, 27) is raised and lowered by a hydraulic cylinder 43 which is attached to the top plate 17 of the housing 5 by pillow block bearings 45 and 47 and to the I-Beam 33 at an attachment device 49. The attachment device 49 includes two lug portions 49*a*, 49*b* each having a through opening 49*c*, 49*d* therein. The piston 43*a* of hydraulic cylinder 43 has a through opening 43*b* which can be aligned with through openings 49*c*, 49*d*, such that a pin 51 passes through openings 49*c*, 49*d* and 43*b*, thereby connecting the hydraulic cylinder 43 to the cutting mechanism.

Control of the hydraulic cylinder 43 is accomplished via an electronic proportional valve 53. The electronic proportional valve 53 is activated to either raise or lower piston 43*a* of cylinder 43 according to programmed instructions from a computer controller 55. The computer controller 55 is programmed to precisely lower and raise the piston 43*a* to programmed depths as the cutting drum 3 advances across the road surface. The computer controller 55 receives electronic impulses which correspond to the distance traveled by the cutting machine 1 from a conventional wheel mounted encoder 57 which is disposed on the rear of a power unit 59. The power unit 59 can be, e.g., a purpose built custom vehicle that pushes cutting machine 1, or a truck arranged to pull cutting machine 1. Power unit 59 provides utilities such as electricity or hydraulics to the various components of cutting machine 1. Power unit 59 also moves the entire cutting machine 1 along the road surface. Encoder 57 may be an optical encoder or a rotary pulse generator.

As the forward speed of the power unit 59 changes, the rate of electronic impulses being received by the controller 55 from encoder 57, correspondingly changes, so that the distance traveled along the road surface by the cutting machine 1 is continuously calculated by the controller 55 based on the input from encoder 57. The computer controller 55 adjusts the speed at which the piston 43*a* of the cylinder 43 is raised and lowered in order to complete its preprogrammed cycle within the forward distance traveled. This rate of vertical motion directly corresponds to the forward speed of the machine.

Figure 5:
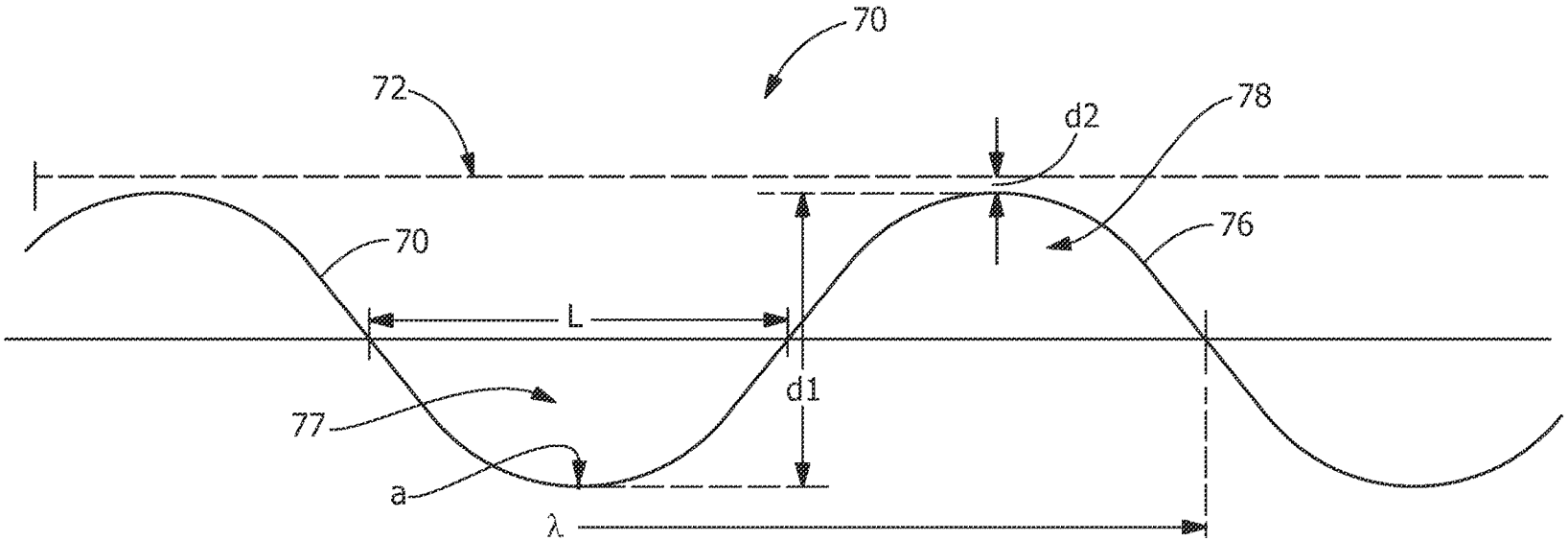
FIG. 5 is a cross-sectional lengthwise view of a continuous sinusoidal strip cut in a roadway.

Thus, referring to FIG. 5, as the cutting drum 3 moves along the direction of travel a distance $\lambda$ corresponding to the specified wavelength of a continuous sinusoidal strip 70, the hydraulic piston 43*a* is raised or lowered to obtain the profile required of continuous sinusoidal strip 70. Depth "d" may also be specified in accordance with a specified radius of curvature "R". The period wavelength $\lambda$ and peak to peak depth "d1" of the continuous sinusoidal strip 70 may be selected to achieve maximum transmission of tire vibration into the vehicle while minimizing the exterior noise disturbance. The wavelength of the sinusoidal profile is preferably chosen such that the forcing frequency at the tires of crossing vehicles will excite one, or a number of, resonant frequencies within the vehicle. It should be noted that a continuous sinusoidal strip may include intermittent gaps, or skips, in the pattern along the roadside, e.g., for placement of reflectors, or at roadway intersections where rumble strips are not indicated. A continuous sinusoidal strip means a strip that extends at least one period of the wavelength.

Figure 7:
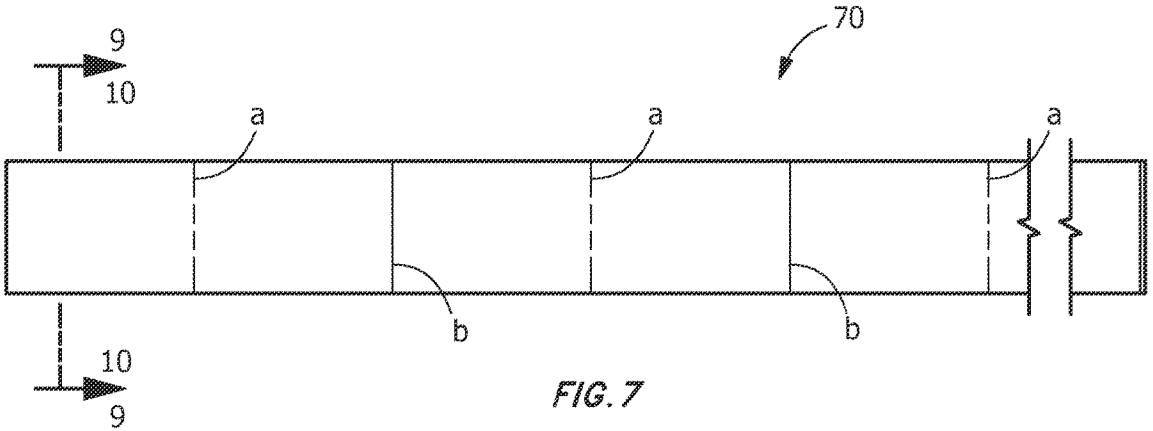
FIGS. 7 and 8 show a plan view and a perspective view, respectively, of an exemplary continuous sinusoidal strip.
Figure 8:
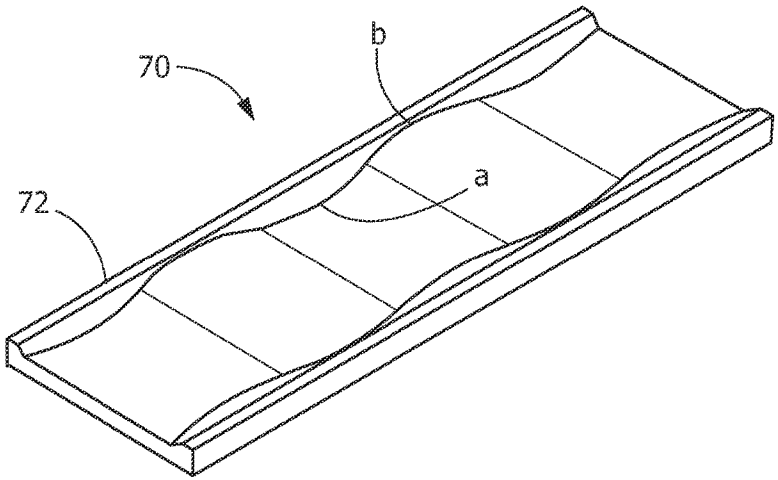
Figure 9:
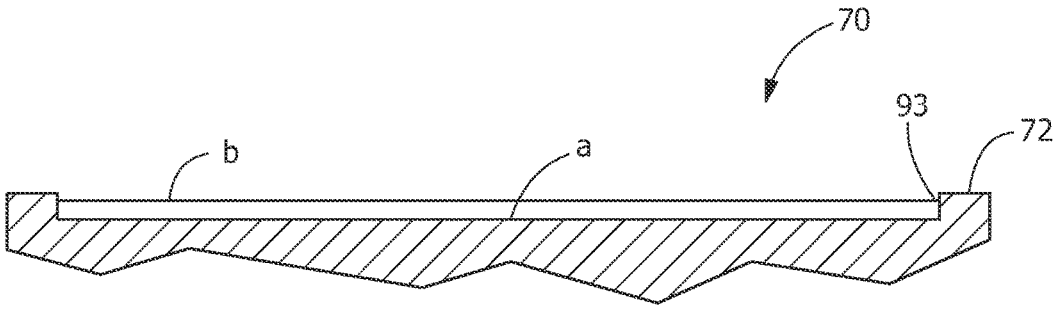
FIGS. 9 and 10 show elevational, cross-sectional views of alternate embodiments of continuous sinusoidal strip taken along lines A-A in FIG. 7.
Figure 10:
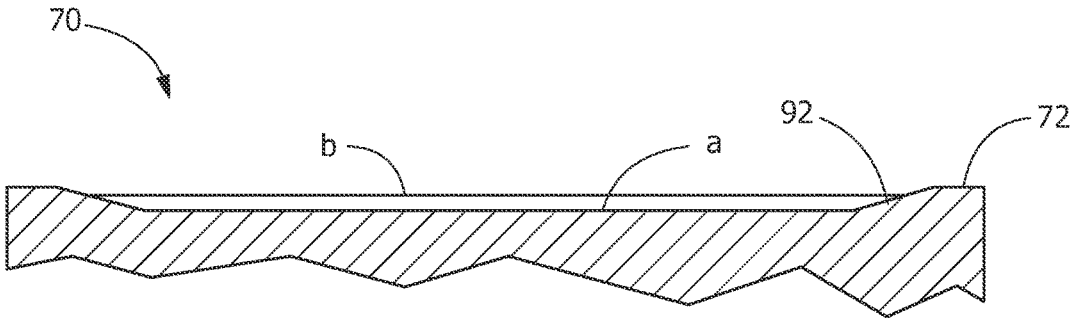

FIGS. 7 and 8 show a plan view and a perspective view, respectively, of continuous sinusoidal strip 70. FIGS. 9 and 10 show an elevational cross-sectional views of alternate embodiments of continuous sinusoidal strip 70, taken along lines A-A in FIG. 7. FIG. 9 shows continuous sinusoidal strip 70 having a square or non-tapered edge. In the embodiment shown in FIG. 9, road surface 72 and continuous sinusoidal strip 70 meet at a generally perpendicular corner 93. In the alternate embodiment shown in FIG. 10, a tapered edge 92 connects road surface 72 with continuous sinusoidal strip 70. Tapered edge 92 provides a gradual entry point for vehicle tires to avoid a sudden shock when the vehicle crosses over from road surface 72 into continuous sinusoidal strip 70. In an exemplary embodiment, tapered edge 92 may be, e.g., up to 25% of the width of continuous sinusoidal strip 70. Continuous sinusoidal strip 70 may include a tapered edge 92 on one or both edges of continuous sinusoidal strip 70.

In one embodiment, wavelength λ of the continuous sinusoidal strip may be selected so that a low forcing frequency is generated at the tires. The human ear is considerably less sensitive to low frequency vibrations and, at frequencies of around 35 to 40 Hz, will be 40 dB less sensitive than at 1 kHz where the sensitivity of the ear is approaching a maximum. It is advantageous therefore for the forcing frequency to be in the range 35 Hz to 40 Hz so that external noise disturbance is kept to a minimum. In contrast, a series of separate depressions as provided in a conventional rumble strip arrangement having similar dimensions to the continuous profile, will produce short duration impulsive forces at the tires which can be resolved into a wide range of forcing frequencies. At least some of these frequencies will be close to 1 kHz and will therefore be significantly more perceptible to the human ear. The invention is not limited to any particular forcing frequency or range of forcing frequencies, and may be used to generate any forcing frequency, including frequencies that are normally audible by humans, e.g., up to 20 kHz.

In the disclosed embodiment, controller 55 is programmed to cut a subsurface sinusoidal strip 70. Cutting drum remains engaged with the road surface continuously once a cutting operation begins. The depth of the high point on the continuous sinusoidal strip 70 is indicated as d2, which is the minimum distance below the road surface indicated by broken line 72. A sinusoidal curve or profile 74 defines the surface of the sinusoidal strip 70. Sinusoidal curve or profile 74 is calculated having a peak to peak amplitude d1. The total depth at the apex a of the sinusoidal strip relative to road surface 72 is equal to (d1+d2), which is the deepest part of the cut, and d2 being the depth at the shallowest part of the cut, or highpoint, b.

The period of the sinusoidal profile 74 is defined by the wavelength λ and cut length L. The bottom half 77 of the sinus period is the cut length L. The top half 78 of the sinus period is (λ minus L). This allows the operator to shorten or elongate the bottom half of the sinus depending on need. The calculated profile 74 is then fed to a proportional-integral-derivative (PID) loop as the requested position to control the valve operation, to control the cutting head position. In order to cut the sinusoidal strip 70, the controller may make adjustments proportionally to forward speed to the PID loop for other cut parameters, for example, hover or depth.

Preprogrammed instructions pertaining to different cylinder 43 stroke cycles relative to required depth, wavelength and profile may be stored and saved in the computer controller 55. This allows the controller 55 to automatically adjust parameters, e.g., the depth and wavelength of sinusoidal strip 70, according to specifications. The controller 55 shall be capable of manipulating the rotary cutting head 3 along the road surface such that the relationships between peak-to-peak, peak, mean, and RMS amplitudes are fixed, known and repeatable. The controller 55 may be field programmable to accommodate conditions affecting either the length of the cut and/or shape and pattern of the sinusoidal wave.

The hydraulic cylinder 43 is a type which contains conventional internal position sensors (not shown) which can provide electronic feedback to the computer controller 55 that is indicative of the position of piston 43*a*. This allows the computer controller 55 to check the actual stroke distance of the cylinder 43 as it travels, and to inform the machine operator by a digital or analog display 60 as to whether or not the cylinder completed its programmed cycle in accordance with the computer controller 55 instructions.

Referring now to FIGS. 1 through 4, the mobile power unit 59 pushes or pulls the entire cutting tool apparatus 61 across the road surface. The cutting tool apparatus 61 is supported on a front or rear end thereof by a solid steel roller 62 which is affixed to a shaft 63 which is carried by two bearings 65 and 67. The bearings 65 and 67 are bolted to a roller housing assembly 69 which is firmly attached to the front of the cutter housing 5 by a series of bolts 71 and slots 73 formed in the roller housing assembly 69.

The entire cutting tool apparatus 61 via the housing 5, is attached to a mast 75 of the power unit 59 by a slew type bearing which allows the cutting apparatus 61 to swivel horizontally. The mast 75 is also attached to the power unit 59 by hydraulic cylinders 79 and 81 (two of each, only 1 shown) and control arms (not shown). The height of the rear of the cutting tool apparatus 61 is adjusted by adjusting the mast cylinders 79. Once the height of the rear of the cutting apparatus 61 is adjusted, the lower mast cylinders 79 are pressurized in a manner which continuously tries to retract the bottom of the mast 75 toward the power unit 59. This feature has the affect of transferring the weight of the power unit 59 to the cutting apparatus 61, and thereby continuously forces the front roller 62 into maintaining contact with the road surface.

The weight transfer process discussed above allows for the weight of the power unit 59 to be transferred to the cutter housing 5. As much weight as possible must be applied on the housing 5 in order to ensure that the cutting drum 3 will be driven and held against the road surface during the required cutting cycle by the hydraulic cylinder 43. Sufficient weight is required so that the cutting cycle can be completed without the tool housing lifting up vertically.

The combination of the pressurized cylinders 79, the slew bearing 77 and the front roller assembly 83 enables the cutting tool apparatus 61 to self align with the road surface. As the cutting apparatus 61 is pushed or pulled along the surface of the road, the front roller 62 follows the horizontal plane of the road.

It is desirable that the cutting drum 3 be parallel to the road surface so that as the piston 43*a* of hydraulic cylinder 43 extends, the cutting drum 3 will engage the road surface and extend into the surface evenly across the width of the continuous sinusoidal strip. The above-described leveling feature is self adjusting so that the operation of the cutting machine can meet and maintain a maximum forward speed and a maximum production capability.

In operation, the operator first orientates the power unit 59 and cutting apparatus 61 over the area to be cut. The cutting drum 3 is suspended and held by the tool cylinder 43 at a hover point above the road surface. Then, the cutting drum 3 is generally orientated parallel to the road surface by adjusting the front roller assembly 83. However, as mentioned above, the front roller assembly 83 can be adjusted such that the cutting drum 3 is not parallel to the underlying surface in the event that a specification or road condition requires a cut which is inconsistent across its length. The operator then engages the drive mechanism of the power unit 59 and moves the cutting apparatus 61 forward. As the power unit 59 advances, the encoder 57 instructs the computer controller 55 to begin executing its preprogrammed instructions and provides a signal to the controller 55 which is indicative of the distance traveled along the road surface. The computer controller 55, based on the signal from the encoder 57, sends signals to the proportional valve 53 which controls the movement of the piston 43*a* of tool cylinder 43, such that the cutting drum 3 is vertically moved into contact with the road surface in a precise manner as it moves across the road surface. The movement of the piston 43*a* is set at a rate which is proportional to the forward speed of the power unit. In other words, the encoder continually supplies the computer with a signal indicative of detected forward movement of the power unit 59 and the computer controller 55 adjusts the piston 43*a* in relation to the forward movement such that the specified sinusoidal profile 74 (FIG. 5) is obtained.

The operator steers the power unit 59 to maintain the alignment of the continuous sinusoidal strip 70 and monitors the computer to ensure that the program cycles are being completed. The operator further controls the operation by adjusting the maximum forward speed and production rate of the cutting machine 1 according to such things as road surface density or hardness. For example, if the road surface is easier to cut because it is soft, the operator will advance the power unit 59 forward at a faster rate in order to increase production. Moreover, due to the self-aligning features of the tool housing 5, the housing 5 will continuously self-adjust itself both horizontally and vertically to the road surface which allows the operator to proceed without stopping to make adjustments to the housing orientation. The resulting pattern left by the cutting apparatus 61 is a continuous sinusoidal strip 70.

The controller 55 may be implemented using a microcontroller. The microcontroller display 60 system may be interfaced with a control panel in cutting machine 1 which may also include, e.g., switches, potentiometers, encoder, head height sensor and an output for valve commands.

Controller 55 controls cutter head depth into a road surface. Cutter head movement varies dependent upon the speed of the cutting machine 1. Controller 55 is programmed to include continuously variable proportional gain and error amplification throughout the entire speed range. Operator input is not required when cutting machine 1 speed changes. Error amplification increases the speed at which cutting drum 3 advances and retracts into and out of the road surface. Further, error amplification maintains the speed of cutting drum 3 proportional to the forward speed of cutting machine 1. Error amplification is accomplished by adding additional depth to the requested depth depending on the speed of the cutting machine 1, which results in a higher output to the valve controlling the speed of the cutter head movement. The additional depth, or depth increment, is dependent on cutting machine forward speed. The proportional gain and error amplification are adjusted automatically over the forward speed range of cutting machine 1. Controller 55 may also be programmed to recalibrate based on fine differences in depth of the cut, such as that which may occur due to cutting teeth wear.

Figure 6:
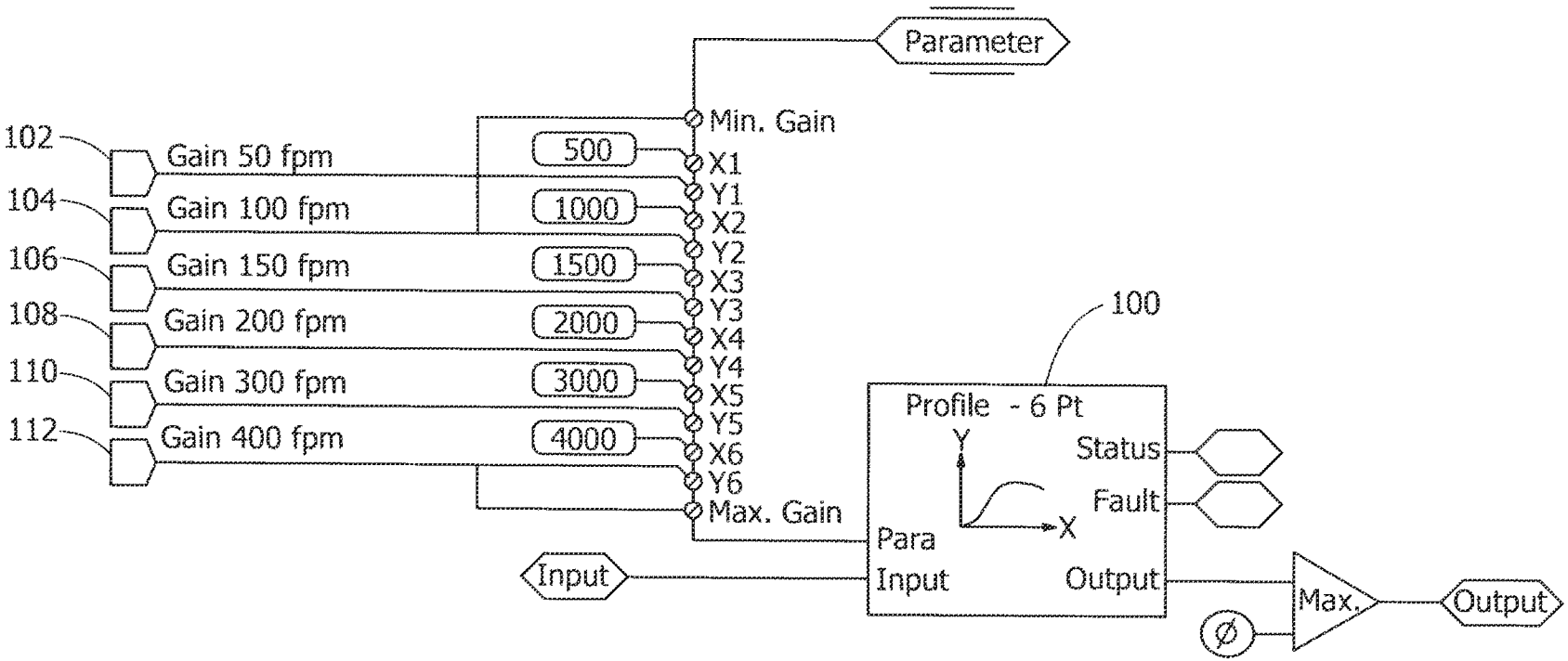
FIG. 6 is a schematic diagram of the I/O points and control profile for the cutting machine controller.

Referring to FIG. 6, in an exemplary embodiment controller 55 may apply a six point profile or function 100 for varying proportional gain and error amplification over a range of forward speed of cutting machine 1. As shown in FIG. 6, the six point profile 100 defines the input/output function, wherein the input parameter is along the x-axis, corresponding to cutting machine speed, and the output signal is represented along the y-axis, corresponding to proportional gain. The gain and error amplification signals each are implemented in the controller 55 in the same manner. FIG. 6 shows the gain signal algorithm. The error amplification algorithm works in the same way so will not be described in detail. At each of six different, predetermined cutting machine speeds, a proportional gain and a depth increment are specified. At a first gain input point 102 representing a first cutting machine speed of 50 feet per minute (f/min), a gain (Y1) is assigned to the output value. At a second speed input point 104, representing a second cutting machine forward speed of 100 f/min, a gain (Y2) is assigned. The gain values will increase from (Y1) to (Y6) to increase the speed of the cutting head with increasing cutting machine speed. In this example, any speed below 100 f/min will have a gain of (Y1), as denoted by the Min Gain setting attached to speed input point 102. Similarly, for a third speed input point 106, a fourth speed input point 108, fifth speed input point 110 and a sixth speed input point 112, a gain (Y3, Y4, Y5 and Y6) is assigned to the output value. Proportional Gain (P-Gain) values are unit-less quantities represented along the y-axis. P-Gain variables may be tuned, e.g., by an operator to the particular cutting machine 1. Different cutting machines 1 may be tuned for different (P-Gain) values due to variations in mechanical properties or hydraulic system components of the machines, for example.

Parameter values for X increase from X1 through X6, i.e., $X1<X2<X3<X4<X5<X6$ which represents the six chosen speeds. The parameter values for X1 . . . X6 can be any values, provided $X1<X2<X3<X4<X5<X6$. This property provides flexibility in shaping the output curve as well as making the system adaptable, e.g., for higher machine speeds in the future. As the forward speed of cutting machine 1 advances between two of the six predetermined input speed points X1–X6, a linear interpolation is used to approximate a desired forward speed profile, from which controller 55 computes the respective proportional gain and depth increment based on the current forward speed. Output gain parameters for Y axis of profile 100 may increase, decrease or be equal between corresponding Y axis points Y1 through Y6. For forward speed ranges greater than the highest specified speed (X6), the proportional gain and depth increment parameters are limited to the value (Y6) attached to Max Gain. Alternately, outputs for speed above and below the predetermined speed ranges for X1 to X6 may be extrapolated from the next two adjacent points (Y1 and Y2, or Y5 and Y6) for the low and high forward speed values, respectively.

In an alternate embodiment, the six predetermined forward speed points may be defined at increments of 50 f/min, beginning at 50 f/min for the first speed point, until the forward speed reaches, and then 100 f/min increments thereafter. For example, the remaining predetermined speed points are then set at 100, 150, 200, 300 and 400 f/min, respectively.

In yet another alternate embodiment, more or less forward speed points may be defined over the desired range of forward speed of cutting machine 1. E.g., forward speed increments may be set at 100 f/min, to vary the rate that the proportional gain and depth increment change every 100 f/min increment of speed. As indicated above, the predetermined speed points can be any values, as long as $X1<X2<X3$, etc. The rate of change of the proportional gain and depth increment values may be varied according to a virtually continuous input/output (I/O) curve as illustrated in FIG. 6. The I/O profile 100 of the forward speed vs. proportional gain/depth increment adjustment may be loaded as software into microcontroller 55 prior to a road surface cutting operation. Alternately, profile 100 may be implemented in hardware or programmable devices.

In one embodiment, microcontroller 55 may be preprogrammed with multiple cutting profiles stored in the microcontroller memory. Cutting profiles may include, e.g., sinusoidal rumble strip profiles with varying dimensions, or conventional rumble strip profiles with various spacing or dimensions. Multiple selection buttons may be provided on the operator control panel or interface to permit the operator to change programs automatically by selecting the associated selection button, without having to enter individual parameters for the desired cutting profile. The selection buttons enable the change from one rumble strip profile to another with little or no delay involved for reconfiguring the profile.

Cutting machine 1 and controller may be configured to accumulate and store statistical data related to the use and life of the cutting machine. When controller 55 is programmed to operate cutting machine 1 under the six point model defined above, the controller 55 may automatically calculate and store a distance that cutting machine 1 travels from the start of a cutting cycle, and the stored distance value is viewable on display 60 in the operator cabin. The controller 55 distance calculation automatically ignores distance covered when the cutting operations are paused—i.e., the cutting head is raised above the surface. Thus, the cutting machine operator is not required to manually throw a switch to disable a summation type counter as was previously the case, thereby eliminating human error in automatically calculating the distance. Distance data may be used for various purposes, e.g., for billing purposes where distance is the basis for determining the contract price, or in estimating wear and tear on a cutting machine for maintenance purposes. The distance value is resettable to zero from the display 60. If not reset to zero, the distance value remains unchanged after cycling power off and on.

For maintenance and servicing, controller 55 also calculates and stores a cumulative distance value while cutting the continuous sinusoidal strip. Controller 55 automatically ignores distance covered when the cutting operations are paused. Cumulative distance data is available when a personal computer (PC) with the appropriate software is connected to the control system. The cumulative distance value is resettable to zero by using said PC and software, e.g., when the maintenance is performed at a predetermined service interval. Cumulative distance data may be used, e.g., to track cutting machine distance since the last service was performed, for preventative maintenance.

The cutting machine also calculates and stores a "lifetime" distance accumulator via controller 55. The lifetime distance value tracks the lifetime cumulative distance of cutting machine 1 that is travelled while cutting continuous sinusoidal strips. Controller automatically ignores distance covered when the cutting operations are not enabled in automatic mode. This data is available when a PC with the appropriate software is connected to the control system. Lifetime cumulative distance travelled value is resettable by using an authorized PC and software. Lifetime cumulative distance travelled data tracks cutting machine distance over its operating life.

Controller 55 may be also configured to calculate the depth of a continuous sinusoidal strip. The depth of a continuous sinusoidal strip may be calculated by capturing the maximum signal from internal position sensors inside hydraulic cylinder 43 and comparing the calculated depth with the calibrated value for ground level for each continuous sinusoidal strip produced. An average depth value is computed by controller 55 from several consecutive depth values, and the average depth value displayed on display 60. The average depth value provides an approximate indication of the depth of the continuous sinusoidal strip, depending on the accuracy of the calibrated ground level as well as changes in slope of the roadway. The average depth value calculation avoids the need for the current normal manual measurements obtained by additional personnel in a chase vehicle.

Controller 55 may be equipped with tuning capability for checking the valve movement and adjustment of cutting head 3 movement into and out of the road surface at various speeds. Tuning may be accomplished via several trial and error procedures where the head is moved up and down without having to contact the road surface or having to move the cutting machine 1. In a warm-up mode, a cutting machine speed is set in controller 55 to simulate cutting machine travel. Any speed can be simulated, and cutting head 3 responds as if cutting machine 1 is in motion at the simulated speed. In operation, cylinders heat the hydraulic oil, which is initially cold and may have different viscosity which may in turn affect tuning of the machine without a warm up cycle. Thus, the proportional gains and depth increments at each of the six predetermined speed points described above may be tested and optimized to produce required depth of cut.

Further accuracy in tuning may be obtained by identification of a calculable parameter, i.e., a backcut. The backcut is defined as a distance that the cutting head cuts behind (relative to cutting machine 1 motion) its initial contact with the road surface. The combination of proportional gain and depth increment should produce a calculated backcut in the range of 0.6-1.4 inches, for example. The backcut values dependent on the required dimensions of the continuous sinusoidal strip depression as well as the type and hardness of material being cut. The stroke or total vertical distance travelled to complete one cycle is another parameter which varies with cut dimensions. The gain and depth increments may be varied to produce an optimum depth, backcut, and stroke required for the conditions at each of the six predetermined speed points described above.

Controller 55 may also be configured to limit the machine speed at which it will cut continuous sinusoidal strips. Controller 55 monitors the cutting machine 1 speed and if it is higher than the limit, the machine's normal cutting operations are suspended until the machine is slowed to below the limit. The speed limit can be modified when a PC with the appropriate software is connected to the controller 55. The speed limit control is settable using said PC and software. If the speed limit is set to zero, the speed limit control is disabled and the machine will operate at any speed. Alternatively, controller 55 may record the number of times and distance that cutting machine travels above the speed limit, and flash a warning on the display 60. The speed limit function may be used, e.g., to ensure warranty conditions are met in the case of a sale or lease of a cutting machine to a third party.

A method for cutting continuous sinusoidal strips in a road surface is described in FIG. 7. The method begins at step 200, by specifying a proportional gain and a depth increment for each speed input values for progressively increasing speed input values. Next, the method proceeds to step 210, and provides an I/O function based on six predetermined cutting machine speed input values. At step 220, the method executes an input/output function for a controller. Next, at step 230, the method proceeds by determining an instantaneous proportional gain and depth increment output value according to a linear interpolation applied between the next lower and the next greater speed values. At step 240, the method varies a proportional gain and an error amplification signal over a range of forward speed of the cutting machine. Next, the method proceeds to step 250, and continues by outputting an instantaneous proportional gain and depth increment from the controller to a control device for cutting rumble strips. Finally, at step 260, the method continues by cutting a continuous strip with sinusoidal cross-sectional profile in the road surface. The method continues iteratively during operation of cutting machine 1.

It should be understood that the application is not limited to the details or methodology set forth in the following description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

The present application contemplates methods, systems and program products on any machine-readable media for accomplishing its operations. The embodiments of the present application may be implemented using an existing computer processors, or by a special purpose computer processor for an appropriate system, incorporated for this or another purpose or by a hardwired system.

It is important to note that the construction and arrangement of the cutting machine control apparatus and method as shown in the various exemplary embodiments is illustrative only. Although only a few embodiments have been described in detail in this disclosure, those who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

As noted above, embodiments within the scope of the present application include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

It should be noted that although the figures herein may show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

What is claimed is:

1. A system for controlling a cutting machine for cutting a continuous sinusoidal strip in a road surface comprising:

a rotatable cutting head;

a cylinder connected to the rotatable cutting head for driving the rotatable cutting head into contact with the road surface; and a controller;

wherein the controller controls the cylinder to adjust the cutting head in continuous engagement with the road surface and to cut a subsurface sinusoidal strip, wherein a high point on the sinusoidal strip having a minimum depth d2 below the road surface and an amplitude d1; wherein a total depth is defined by d1 plus d2 at a the deepest point of the strip.

2. The system of claim 1, wherein the rotatable cutting drum moves along the direction of travel a distance corresponding to a predetermined wavelength of the continuous sinusoidal strip in response to the controller, and a hydraulic piston is raised or lowered to obtain the profile required for the continuous sinusoidal strip.

3. The system of claim 1, wherein a predetermined depth of the continuous sinusoidal strip is associated with a radius of curvature "R", and the period wavelength $\lambda$ and the predetermined depth of the continuous sinusoidal strip provide a maximum transmission of tire vibration into a vehicle and minimizes an exterior noise disturbance.

4. The system of claim 1, wherein a wavelength of the sinusoidal profile corresponds with a forcing frequency that excites at least one resonant frequency within a vehicle.

5. The system of claim 1, wherein the continuous sinusoidal strip profile corresponds to a low forcing frequency generated by a plurality of tires of a vehicle.

6. The system of claim 5, wherein the forcing frequency is in a range of 35 Hz to 40 Hz.

7. The system of claim 1, wherein the controller is programmed to direct the cutting head into a surface at variable speed and depth so as to cut a subsurface sinusoidal strip in the road surface.

8. The system of claim 1, wherein the cutting drum remains engaged in the road surface during the entire cutting operation.

9. The system of claim 1, wherein a period of the continuous sinusoidal profile is defined by a wavelength λ and a cut length L; wherein a bottom half of a sinus period of the continuous sinusoidal profile is a length L.

10. The system of claim 9, wherein a top half of the sinus period has a depth of λ minus L.

11. The system of claim 1, wherein the controller further comprises preprogrammed instructions pertaining to a plurality of cylinder stroke cycles relative to require depth, wavelength and profile, to allow the controller to automatically adjust parameters according to at least one specified depth, wavelength and profile.

12. The system of claim 1, further comprising a hydraulic cylinder which provides an electronic feedback signal to the controller indicative of the position of piston; and wherein the computer controller is configured to check an actual stroke distance of the cylinder as it travels, and to indicate to a machine operator whether or not the cylinder completed a cycle in accordance with the computer controller.

13. A method for cutting continuous sinusoidal strips in a road surface comprising:

specifying a proportional gain and a depth increment for each speed input values for progressively increasing speed input values;

defining a high point on the sinusoidal strip having a minimum depth d2 below the road surface and an amplitude d1, wherein a total depth is defined by d1 plus d2 at a the deepest point of the strip, and executing an input/output function for controller;

providing an n PO function based on a plurality of predetermined cutting machine speed input values;

determining an instantaneous proportional gain and depth increment output value according to a linear interpolation applied between the next lower and the next greater speed values;

varying a proportional gain and an error amplification signal over a range of forward speed of the cutting machine;

outputting an instantaneous proportional gain and depth increment from the controller to a control device for cutting a continuous sinusoidal strip in the road surface; and cutting the continuous strip having a sinusoidal cross-sectional profile that is below the road surface by at least the minimum distance d2.

14. The method of claim 13, further comprising permitting an operator to shorten or elongate a bottom half of the sinus.

15. The method of claim 14, further comprising feeding the calculated profile to a PID loop at the requested position to control the valve operation, to control the cutting head position throughout a wavelength of the sinusoidal profile.

16. The method of claim 15, further comprising adjusting proportionally to forward speed to the PID loop for other cut parameters, for example, hover or depth.

17. The method of claim 13, further comprising continuing to operate the cutting machine.

18. The method of claim 13, further comprising selecting a predetermined wavelength of the continuous sinusoidal profile corresponding with a forcing frequency of a vehicle to excite at least one resonant frequency within the vehicle.

* * * * *